US011186794B1

(12) United States Patent
Chaffin et al.

(10) Patent No.: US 11,186,794 B1
(45) Date of Patent: Nov. 30, 2021

(54) HYBRID FUEL GRAIN AND METHOD FOR MAKING SAME

(71) Applicant: United States of America as represented by the Administrator of NASA, Washington, DC (US)

(72) Inventors: Jessica Pratt Chaffin, Huntsville, AL (US); Sadie Mae Mikiah Boyle, Olympia, WA (US); John W. Dankanich, Huntsville, AL (US); George Taylor Story, Huntsville, AL (US); Robert Houston Taylor, Jr., New Market, AL (US)

(73) Assignee: United States of America as represented by the Administrator of NASA, Washington, DC (US)

( * ) Notice: Subject to any disclaimer, the term of this patent is extended or adjusted under 35 U.S.C. 154(b) by 0 days.

(21) Appl. No.: 16/291,939

(22) Filed: Mar. 4, 2019

(51) Int. Cl.
*C10L 5/36* (2006.01)
*C10L 10/00* (2006.01)

(52) U.S. Cl.
CPC ..... *C10L 5/363* (2013.01); *C10L 10/00* (2013.01); *C10L 2200/0453* (2013.01); *C10L 2270/04* (2013.01); *C10L 2290/06* (2013.01); *C10L 2290/32* (2013.01)

(58) Field of Classification Search
CPC .. C10L 5/36; C10L 5/363; C10L 5/365; C10L 5/146; C10L 10/00; C10L 2200/0453; C10L 2270/04; C10L 2290/06; C10L 2290/32; C11C 5/00; C11C 5/002; C11C 5/004
See application file for complete search history.

(56) References Cited

U.S. PATENT DOCUMENTS

| | | | | |
|---|---|---|---|---|
| 3,668,288 | A | 6/1972 | Takahashi | |
| 3,723,593 | A | 3/1973 | Ono | |
| 3,925,029 | A | 12/1975 | Wilson | |
| 6,740,180 | B1 * | 5/2004 | Cesaroni | C06B 45/10 149/19.91 |
| 7,286,893 | B1 | 10/2007 | Mazumder | |
| 9,551,054 | B2 | 1/2017 | Shikama et al. | |
| 10,309,346 | B2 * | 6/2019 | Jones | F02K 9/18 |

(Continued)

FOREIGN PATENT DOCUMENTS

| | | | |
|---|---|---|---|
| CN | 105802740 B | * | 8/2017 |
| RU | 2483533 C1 | * | 6/2013 |

OTHER PUBLICATIONS

Machine Translation of CN 105802740B (Year: 2016).*

(Continued)

*Primary Examiner* — Ellen M McAvoy
*Assistant Examiner* — Ming Cheung Po
(74) *Attorney, Agent, or Firm* — James J. McGroary; Helen M. Galus

(57) ABSTRACT

A hybrid fuel grain is a solid homogenous mixture consisting of paraffin, thermoplastic adhesive, and black dye. A homogenous mixture of the three ingredients is heated in a preheated cast. The cast with the homogenous mixture therein in is placed in an oven. The temperature of the oven is reduced to a selected ambient temperature in accordance with a cooling schedule that comprises a two-step cooling process repeated until the selected ambient temperature is achieved.

8 Claims, 3 Drawing Sheets

(56) References Cited

U.S. PATENT DOCUMENTS

| | | | | |
|---|---|---|---|---|
| 2003/0148239 | A1* | 8/2003 | Szczerba | C11C 5/002 431/275 |
| 2013/0042951 | A1* | 2/2013 | Fuller | B29C 39/006 149/14 |
| 2018/0253003 | A1* | 9/2018 | Furue | G03F 7/105 |

OTHER PUBLICATIONS

Machine Translation of RU-2483533-C1 (Year: 2013).*
Deveci, Murat; Relief of Residual Stresses; Stresstech.com; pp. 1-9; Stresstech bulletin 10; https://www.stresstech.com/en-fi/know-how/articles/stresstech-bulletin-10-relief-residual-stresses/.

* cited by examiner

HYBRID FUEL GRAIN AND METHOD FOR MAKING SAME

ORIGIN OF THE INVENTION

The invention described herein was made by employees of the United States Government and may be manufactured and used by or for the Government of the United States of America for governmental purposes without the payment of any royalties thereon or therefor.

BACKGROUND OF THE INVENTION

1. Field of the Invention

This invention relates to rocket motors. More specifically, the invention is a hybrid fuel grain for a rocket motor as well as a method for making same where the hybrid fuel grain is scalable in size and is suitable for storage and use in low-temperature environments.

2. Description of the Related Art

Rocket motors utilizing a hybrid propulsion system (known as hybrid rocket motors) include what is known as a hybrid fuel grain, i.e., solid fuel components but excluding an oxidizer. The exclusion of the oxidizer improves the safety of the ultimate hybrid rocket motor since the oxidizer is stored in a separate pressure vessel. However, the manufacture of larger hybrid fuel grains introduces a number of problems owing to their use of paraffin fuel.

During fabrication, a hybrid fuel grain's paraffin fuel must be melted and cooled. However, paraffin fuels can shrink by as much as 15% by volume during cool down from a liquid state to a solid state. Such cooling-based shrinkage leads to fuel grain cracking defects and de-bonding defects that impact fuel grain safety, performance, and sustainability. The impacts of these defects increase with the size of a fuel grain and/or temperature cycling experienced by the fuel during storage or operation. Rocket motor engineers designing for cold environments (e.g., Mars) are faced with both of these obstacles as the hybrid rocket motors needed are large and must be capable of storage/use in cold environments.

SUMMARY OF THE INVENTION

Accordingly, it is an object of the present invention to provide a hybrid fuel grain.

Another object of the present invention is to provide a method for making a hybrid fuel grain.

Still another object of the present invention is to provide a hybrid fuel grain and method for making same that is scalable and produces a fuel grain that is suitable for storage/use in low-temperature environments.

Other objects and advantages of the present invention will become more obvious hereinafter in the specification and drawings.

In accordance with the present invention, a hybrid fuel grain is a solid homogenous mixture consisting of paraffin, thermoplastic adhesive, and black dye. A method for making the hybrid fuel grain begins with a homogenous mixture of the three ingredients heated in a preheated cast. The cast with the homogenous mixture therein in is placed in an oven. The temperature of the oven is reduced to a selected ambient temperature in accordance with a cooling schedule that comprises a two-step cooling process repeated until the selected ambient temperature is achieved. The two-step cooling process has a first cooling step that reduces the temperature of the oven by 3° C. over a time period of one hour, and a second cooling step that holds the temperature of the oven achieved by the first cooling step until the homogenous mixture achieves an acceptable temperature gradient.

BRIEF DESCRIPTION OF THE DRAWING(S)

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
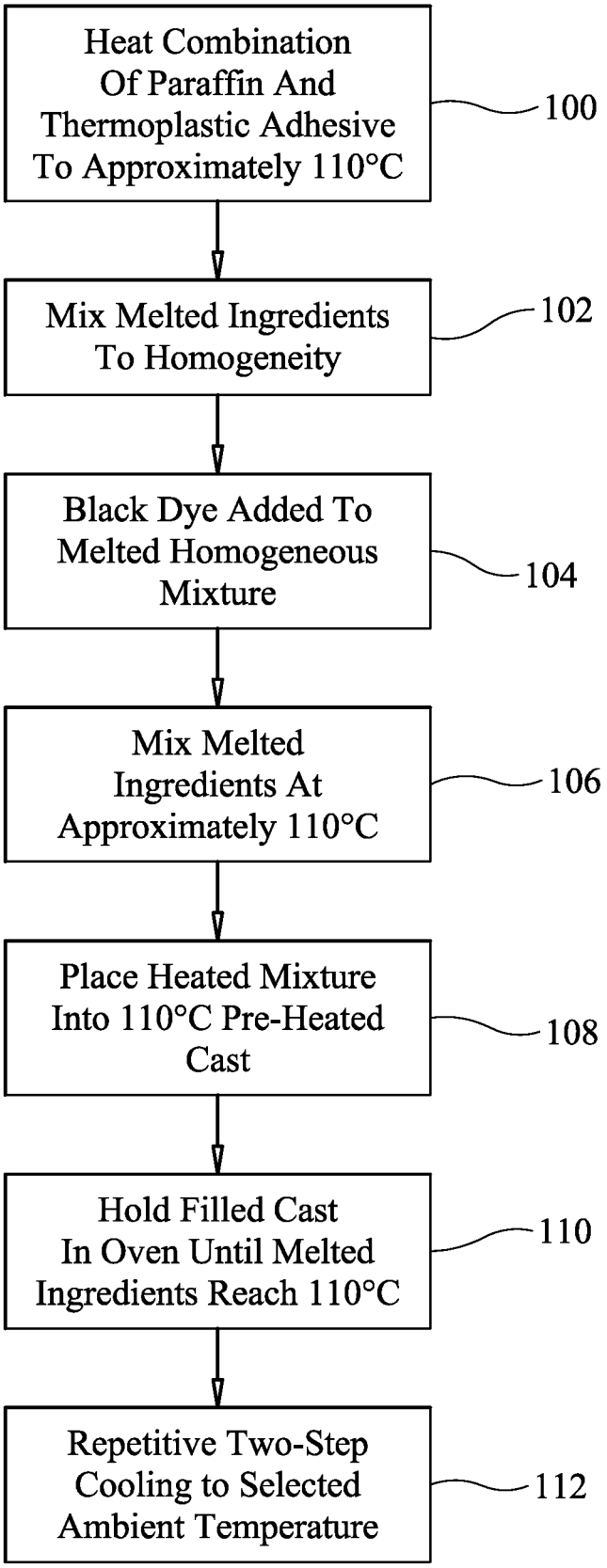
FIG. 1 is a flow diagram of a method of making a hybrid fuel grain in accordance with an embodiment of the present invention.

Referring now to the drawings and more particularly to FIG. 1, a flow diagram depicts the fabrication steps associated with making a hybrid fuel grain in accordance with an embodiment of the present invention. The resulting hybrid fuel grain is a solid structure that can be scaled in size depending on an application's requirements. As will be explained further below, the resulting hybrid fuel grain provides a homogenous solid mixture that does not crack during fabrication or storage, and prevents premature penetration of flame line radiation into the hybrid fuel grain during a burn thereof.

The resulting hybrid fuel grain provides superior performance characteristics in low-temperature environments, e.g., at temperatures that will be encountered in a Mars environment. Further, the resulting hybrid fuel grain's solid homogenous mixture can be subsequently processed to incorporate an internal, intentionally-formed void structure designed to control the burn characteristics of the hybrid fuel grain.

The hybrid fuel grain of the present invention has the following three ingredients:

paraffin;

thermoplastic adhesive; and black dye.

A variety of paraffins, thermoplastic adhesives, and black dyes can be used without departing from the scope of the present invention. In accordance with an embodiment of the present invention, an exemplary hybrid fuel grain was fabricated with 79.76 weight percent paraffin, 19.94 weight percent thermoplastic adhesive, and 0.3 weight percent black dye. However, it is to be understood that the weight percentages of these three ingredients could be varied without departing from the scope of the present invention.

A method for making a hybrid fuel grain in accordance with the present invention applies to a variety of formulations thereof to include the above-noted exemplary weight percents of the three ingredients. In general, the paraffin and thermoplastic adhesive are heated to approximately 110° C. at step 100 to thereby melt the two ingredients. Step 102 mixes the two melted ingredients to form a homogenous liquid mixture. Next, at step 104, the selected weight percent of black dye is added to the heated homogenous mixture from step 102. The three ingredients are mixed to homogeneity at step 106 with the temperature maintained at approximately 110° C. At step 108, the liquid mixture from step 106 is placed in a preheated cast, the shape of which will define the outer shape of the ultimate fuel grain. For example, the cast could be preheated and then left in a casting oven (not shown) with the liquid mixture from step 106 then being placed in the preheated cast. It is to be understood that the shape/size of the cast and, therefore, the outer shape of the ultimate fuel grain, are not limitations of the present invention. At step 110, the filled cast from step 108 is held at the casting oven's preheated temperature until the mixture reaches a temperature of 110° C. From this point on, the method of the present invention employs a repetitive two-step cooling (step 112) that reduces the temperature of the homogenous mixture in the cast to a selected ambient temperature at which the homogenous mixture will remain a solid.

Figure 2:
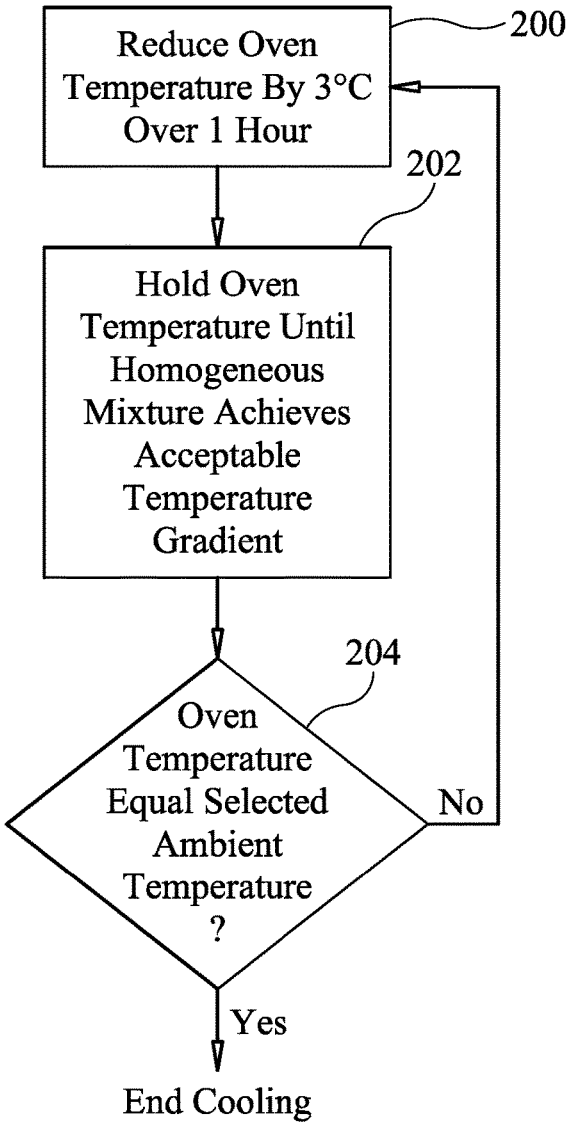
FIG. 2 is a flow diagram of a two-step cooling process used in an embodiment of the present invention.

Referring now to the flow diagram in FIG. 2, an exemplary repetitive two-step cooling process for step 112 is illustrated. The first step 200 of the cooling process reduces the temperature of the casting oven by 3° C. over the course of an hour. For example, the 3° C. temperature reduction could be governed by a linear reduction equation over the one hour time period. At the conclusion of step 200, a temperature hold step 202 is implemented. More specifically, the temperature of the casting oven is held constant at step 202 for a period of time sufficient to allow the homogeneous mixture within the cast to achieve an acceptable temperature gradient across the homogenous mixture with the ideal gradient being zero thereby indicating temperature uniformity. So, for example, during the first cycle through the two-step cooling process, the temperature of the casting oven is reduced to 107° C. (step 200), and then held at 107° C. (step 202) for the hold time needed to achieve temperature uniformity within the homogenous mixture. While the hold times implemented at step 202 will vary with size of the fuel grain (i.e., the size of the homogenous mixture in the cast), hold times implemented step 202 will generally be in the range of 4-10 hours. At the conclusion of the requisite hold time, the process repeats (as indicated by decision step 204) if the temperatures of the oven has not yet reached the selected ambient temperature.

Figure 3:
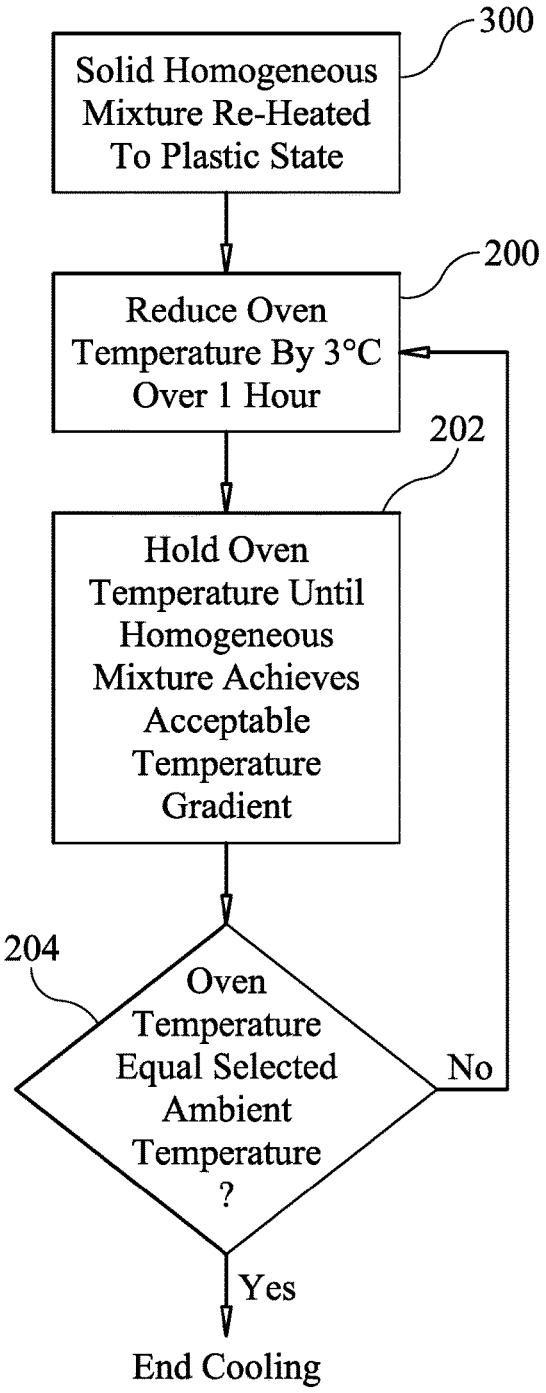
FIG. 3 is a flow diagram of additional heating and cooling steps to remove residual stresses in accordance with another embodiment of the present invention.

At the conclusion of the two-step cooling process described above, the homogenous mixture within the cast has been cooled to a solid state thereof. Larger sizes of fuel grains may require additional processing to assure the elimination of micro-cracks within the solid structure. In such cases, a re-heating and re-cooling process can be implemented as illustrated in FIG. 3. Firstly, the solid homogenous mixture resulting from the two-step cooling process (FIG. 2) is re-heated at step 300. More specifically, step 300 re-heats the solid homogenous mixture to its plastic state. For the exemplary hybrid fuel grain mixture described herein, the plastic-state temperature is approximately 55° C. After re-heating step 300, the above-described repetitive two-step cooling process steps 200/202/204 are again implemented until the solid homogenous mixture again achieves the selected ambient temperature.

Figure 4A:
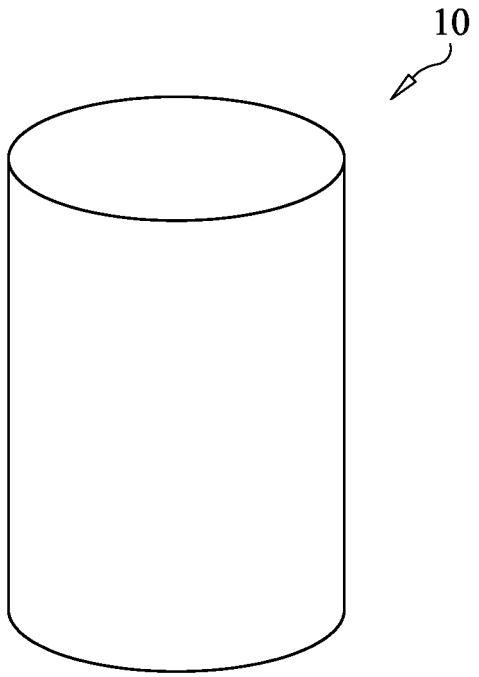
FIG. 4A is a perspective view of a void-free solid hybrid fuel grain in accordance with an embodiment of the present invention.

The hybrid fuel grain of the present invention can be sized/shaped in accordance with the needs of a particular rocket motor application. By way of a non-limiting example, FIG. 4A illustrates a completely solid cylindrical hybrid fuel grain 10. However, the present invention is not so limited as some solid hybrid fuel grains are designed to provide specific performance characteristics aided and/or defined by one or more intentionally-shaped voids or void regions within the solid structure in order to control the burn characteristics (e.g., burn rate) of the hybrid fuel grain. The void or void regions can be generated in a variety of ways without departing from the scope of the present invention. For example, void or void regions can be machined into the solid structure yielded by the fabrication process described herein.

Figure 4B:
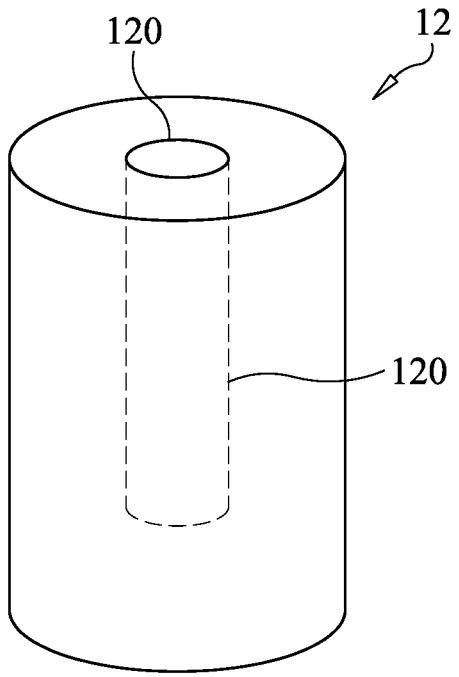
FIG. 4B is a perspective view of a solid hybrid fuel grain having a central axial bore extending partially therein in accordance with another embodiment of the present invention.
Figure 4C:
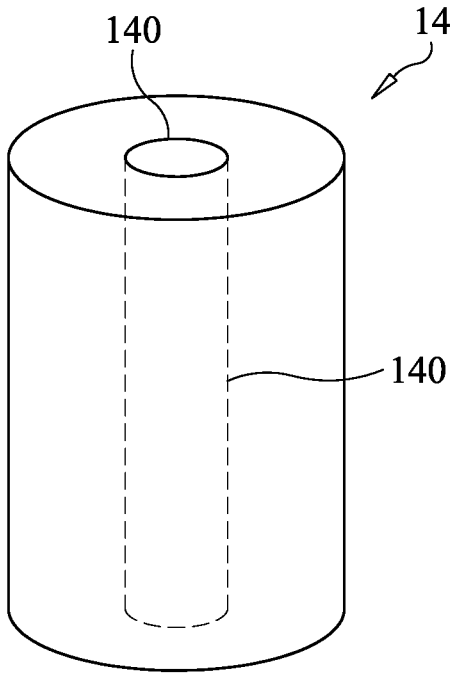
FIG. 4C is a perspective view of a solid hybrid fuel grain having a central axial bore passing completely there through in accordance with another embodiment of the present invention.
Figure 4D:
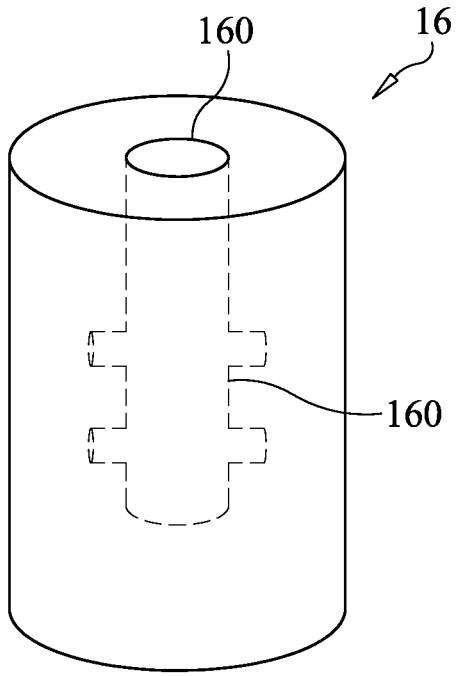
FIG. 4D is a perspective view of a solid hybrid fuel grain having a complex and intentionally-shaped void formed therein in accordance with still another embodiment of the present invention.

Several non-limiting hybrid fuel grains in accordance with the present invention incorporating intentionally-shaped voids are illustrated in FIGS. 4B-4D. It is to be understood that the outer cylindrical structure of each fuel grain is not a limitation of the present invention. Referring first to FIG. 4B, a hybrid fuel grain 12 fabricated in accordance with the present invention incorporates a subsequently-generated central axial bore 120 that extends partially into fuel grain 12. FIG. 4C illustrates a hybrid fuel grain 14 fabricated in accordance with the present invention and subsequently processed (e.g., machined) to incorporate a central axial bore 140 that passes completely through fuel grain 14. FIG. 4D illustrates a hybrid fuel grain 16 fabricated in accordance with the present invention and subsequently processed to incorporate a complex-shaped bore 160 that can extend partially into fuel grain 16 (as shown) or could pass completely through fuel grain 16 without departing from the scope of the present invention.

Each of the above-described bores is fluidly contiguous, i.e., a contiguous bore structure in terms of being filled with a fluid. However, multiple discrete bores could also be incorporated into the solid hybrid fuel grain without departing from the scope of the present invention.

The advantages of the present invention are numerous. The hybrid fuel grain's formulation and fabrication process yields a crack and stress-free fuel grain that is scalable, transportable, and operationally sound in low-temperature environments such as Mars. The inclusion of black dye yields a hybrid fuel grain that prevents premature penetration of flame line radiation into the hybrid fuel grain during a burn thereof.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A hybrid fuel grain consisting of a solid homogenous mixture of 79.76 weight percent of a paraffin, 19.94 weight percent of a thermoplastic adhesive, and 0.3 weight percent of a black dye wherein said black dye prevents premature penetration of flame line radiation into said solid homogenous mixture during a burn thereof.

2. A hybrid fuel grain as in claim 1, wherein said solid homogenous mixture comprises a void-free solid structure.

3. A hybrid fuel grain as in claim 1, wherein said solid homogenous mixture comprises a solid structure having at least one intentionally-shaped void in said solid structure.

4. A hybrid fuel grain as in claim 3, wherein said at least one intentionally-shaped void comprises a fluidly contiguous void.

5. A hybrid fuel grain as in claim 1, wherein said solid homogenous mixture comprises a solid cylinder thereof.

6. A hybrid fuel grain as in claim 1, wherein said solid homogenous mixture comprises a solid cylinder having a central axial bore.

7. A hybrid fuel grain as in claim 6, wherein said central axial bore passes completely through said solid cylinder.

8. A hybrid fuel grain as in claim 6, wherein said central axial bore extends partially into said solid cylinder.

* * * * *